United States Patent [19]

Steck

[11] 4,002,018

[45] Jan. 11, 1977

[54] DEVICE FOR MODIFYING THE YARN WRAP ANGLE IN A FRICTION FALSE-TWIST DEVICE

[75] Inventor: Arnold Steck, Wattwil, Switzerland

[73] Assignee: Heberlein Maschinenfabrik AG, Wattwil, Switzerland

[22] Filed: Feb. 27, 1976

[21] Appl. No.: 662,288

[30] Foreign Application Priority Data

Apr. 18, 1975 Switzerland ..... 4976/75
Dec. 3, 1975 Switzerland ..... 15711/75

[52] U.S. Cl. ..... 57/77.4; 57/77.45
[51] Int. Cl.[2] ..... D02G 1/08
[58] Field of Search ..... 57/77.4, 77.42, 77.45, 57/34 HS, 157 TS

[56] References Cited

UNITED STATES PATENTS

| | | | |
|---|---|---|---|
| 3,287,890 | 11/1966 | McIntosh et al. | 57/77.4 |
| 3,695,020 | 10/1972 | Richter | 57/77.4 |
| 3,820,317 | 6/1974 | Raschle | 57/77.4 |
| 3,854,276 | 12/1974 | Marzoli | 57/77.4 |
| 3,901,011 | 8/1975 | Schuster | 57/77.4 |
| 3,911,661 | 10/1975 | Naylor | 57/77.4 |
| 3,919,833 | 11/1975 | Horvath et al. | 57/77.4 |
| 3,932,985 | 1/1976 | Naylor | 57/77.4 |
| 3,942,313 | 3/1976 | Gassner et al. | 57/77.4 |
| 3,955,350 | 5/1976 | Schuster | 57/77.4 |

*Primary Examiner*—John Petrakes
*Attorney, Agent, or Firm*—Larson, Taylor and Hinds

[57] ABSTRACT

A friction false-twist device for texturing textile yarns of thermoplastic synthetic material comprises a main friction element mounted to rotate about a first fixed axis and formed as a sphere or ellipsoid with at least one circular groove centered on the axis, into which projects the rim of a friction disc rotatable about a second fixed axis parallel to the first. Yarn to be twisted is wrapped partially over the curved surface of the main friction element and past the edge of the friction disc to a yarn-guide unit adjustable over substantially half the curved surface of the main friction element at a constant distance from that surface. The yarn-guide unit includes a guiding disc which causes the yarn to deviate after leaving the main friction element. To avoid excessive yarn tension the guide unit is adjusted to provide a comparatively small wrap angle over the curved surface during threading, and is then adjusted to provide a larger wrap angle for effective twisting. The yarn-guide unit may be mounted to slide on an arcuate rail along which it can be locked in any position. To absorb high tension that may arise at the beginning of false twisting, a buffer such as a spring may be interposed between the yarn guide unit and an adjustable abutment.

10 Claims, 5 Drawing Figures

DEVICE FOR MODIFYING THE YARN WRAP ANGLE IN A FRICTION FALSE-TWIST DEVICE

FIELD OF THE INVENTION

The present invention relates to a device for modifying the yarn wrap angle in a friction false-twist device for texturing textile yarns of thermoplastic synthetic material.

DESCRIPTION OF THE PRIOR ART

In U.S. Pat. No. 3,919,833 granted Nov. 18, 1975 to Lajos Horvath and Arnold Steck there is described a friction false-twist device comprising friction elements disposed on two parallel shafts, the main friction element having a spheroidal shape (i.e. the shape of a sphere or of an ellipsoid or of a body similar to an ellipsoid) and being provided with at least one annular groove extending transversely with respect to the rotation axis, whereas the secondary friction element comprises at least one circular disc extending transversely with respect to its rotation axis, the rim of the circular disc being in engagement with the annular groove. Furthermore, the device comprises guide means for feeding and removing the textile yarn transversely with respect to the rotation axis of the main friction element.

The convex surface of the main friction element as well as the marginal portion of the disc or each disc forming the secondary friction element may consist of a material with a high friction coefficient with respect to a textile yarn of synthetic material. For example, the material having a high friction coefficient may be synthetic polyurethane material. The textile yarn fed to and removed from the main friction element transversely with respect to the rotation axis thereof is applied onto the convex surface of the main friction element and is pressed against this element by yarn tension.

It has been found that, in some cases, the application of the yarn onto the contact surfaces of the friction twist element rotating at full operation speed may cause difficulties. On the one hand, the yarn may be exposed to excessively high drawing tension which may lead to yarn breakage, and on the other hand, the force with which the yarn is pressed on the contact surface must be big enough to assure safe false-twisting. It has now been found that where these difficulties arise, they can be avoided if the yarn is initially wrapped around the main friction element at a relatively small wrap angle and if the wrap angle is only afterwards adjusted to an amount assuring safe false-twisting.

SUMMARY OF THE INVENTION

It is the purpose of the present invention to provide a device which permits in a simple and safe manner the adaptation of the wrap angle during operation without thereby disturbing the yarn passage. According to the present invention, this feature is achieved by a yarn-guide unit which is movable around one half of the main friction element at a constant distance from its surface. The yarn-guide unit may advantageously be arranged on a sliding element which can be adjusted along an arcuate rail which extends round half of the main friction element at a constant distance from its surface and which can be fixed in any selected position on the rail. The yarn-guide unit may furthermore advantageously consist of a combination of an open yarn guide and of a yarn guiding disc.

During the starting phase, i.e. when the false twisting begins, a high yarn tension appears for some seconds and in some cases this can lead to yarn breakages.

Advantageously therefore an abutment for the sliding element is provided and a resilient buffer is interposed between the abutment and the sliding element. The buffer is preferably a spring, for example a helical spring, a blade spring or a zig-zag spring. Furthermore, as buffers structures such as folded or ribbed tubes of resilient material, for example of rubber, are suitable.

DESCRIPTION OF THE DRAWINGS

Examples of the invention are hereinafter described in more detail with reference to the accompanying drawings wherein:

In FIG. 1, a main friction element 3 mounted on a rotatable shaft 1 consists of two spherical segments 4, 5 with an intermediate spacer member 6 by which an annular groove 7 is formed. A secondary friction element 8 mounted on a rotatable shaft 2 comprises an annular disc 9, the marginal portion 9' of which consists of synthetic polyurethane material. Each of the sperical surfaces 4, 5 has a surface coating of polyurethane synthetic material. The shafts 1 and 2 rotate in the same sense of rotation.

Figure 1:
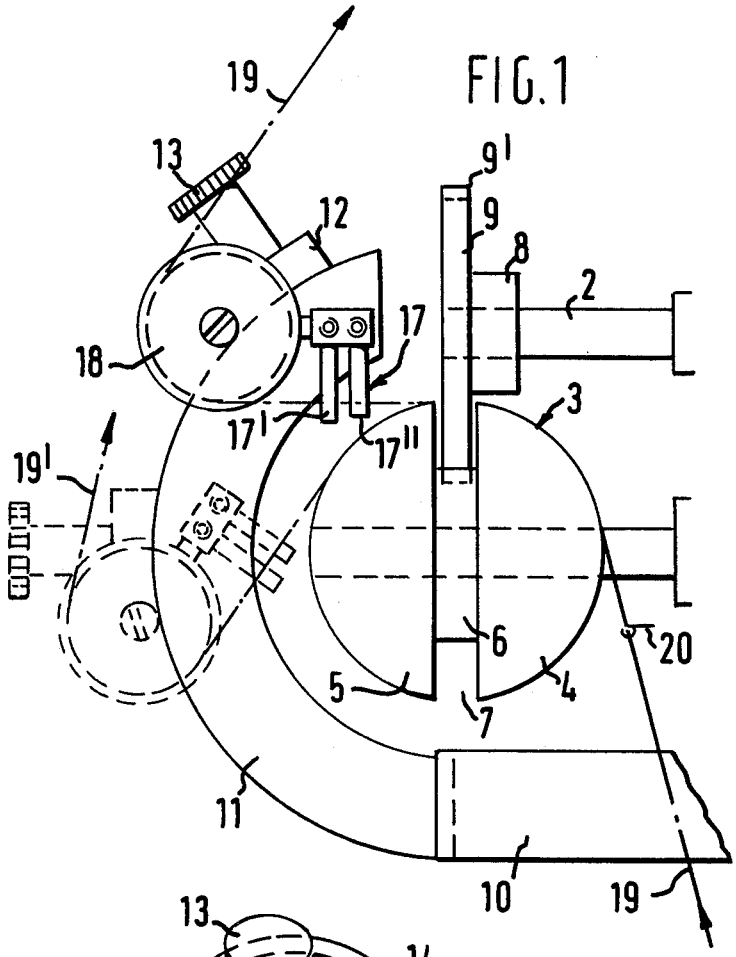
FIG. 1 shows a lateral elevation of a friction false-twist device equipped with a device for modifying yarn wrap angle therein.

On a support 10, an arcuate U-section rail 11 is mounted so that the center of the arc corresponds to the center of the spherical main friction element 3. Therefore, the distance between the rail and the surface of the spherical segment 5 is constant over the whole length of the rail. In the groove of the U-section rail, there is arranged a sliding element 12 which can be fixed by a screw 13 in any position along the rail. On the sliding element 12, there is adjustably mounted a support 14 extending transversely with respect to the lengthwise direction of the rail. The support 14 is fixed in adjusted position by a screw 16 passing through a longitudinal slot 15. On the support 14, there is fixed a yarn-guide unit which consists of an open thread-guide 17 having two pins 17', 17'' of oxide ceramic material and of a yarn guiding disc 18.

Figure 2:
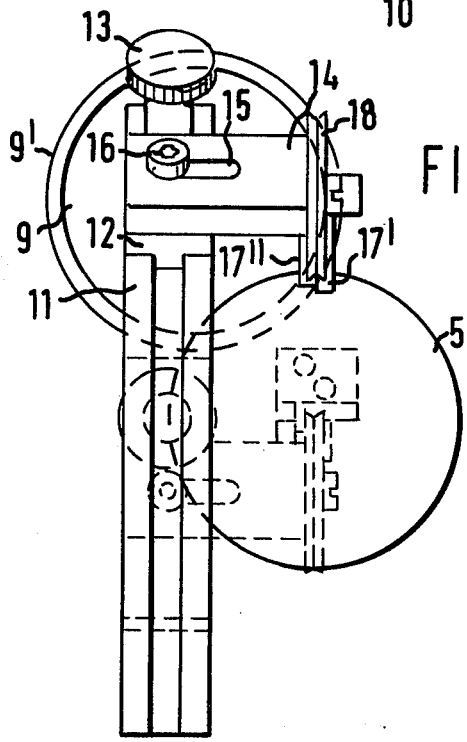
FIG. 2 in a front elevation of the assembly of FIG. 1.

When the yarn 19 is applied to the friction element, the sliding element 12 is in the position shown by full lines in FIGS. 1 and 2.

The yarn 19 coming from a heating device (not shown) for heat-setting the false-twist reaches the spherical segment 4 through a thread-guide 20, the yarn being in contact with the spherical segment over an angle of approximately 60°. The yarn continues through the open thread-guide 17, passes round the guiding disc 18, and from there reaches a wind-up device (not shown). After the yarn 19 has been applied against the friction element 3, the fixing screw 13 is released, the sliding element 12 brought into the position shown by broken lines and again fixed by fixing screw 13. The yarn 19 is now wrapped round the surface of spherical segments 4 and 5 at an angle of approximately 160° whereby safe false-twisting of the yarn is assured.

When altering the position of the sliding element 12 on the arcuate rail 11, the distance between the position in which the yarn 19 leaves the spherical segment 5 and the position in which it reaches the guiding disc 18 always remains the same. The advantage of this is that, upon modification of the wrap angle, no longitudinal disturbance of the running yarn takes place and therefore there is no resulting danger of interruptions in operation. Furthermore, upon modification of the position of the yarn guide unit, the yarn 19 always reaches the pins 17', 17'' of the open thread guide 17 at an angle of substantially 90° with respect to the radius from the point of contact of the yarn with the friction element 3 to the centre of the friction element. Therefore, in all positions of the thread guide unit, safe guiding of the yarn is assured. In a modification not shown in the drawing, the yarn-guide unit (17, 18) may be disposed on a pivotable arm, the pivoting axis of which lies perpendicular to the axis of shaft 1 and passes through the centre of the spherical or ellipsoidal main friction element. The pivotable yarn therefore extends transversely with respect to the direction of yarn movement.

Figure 3:
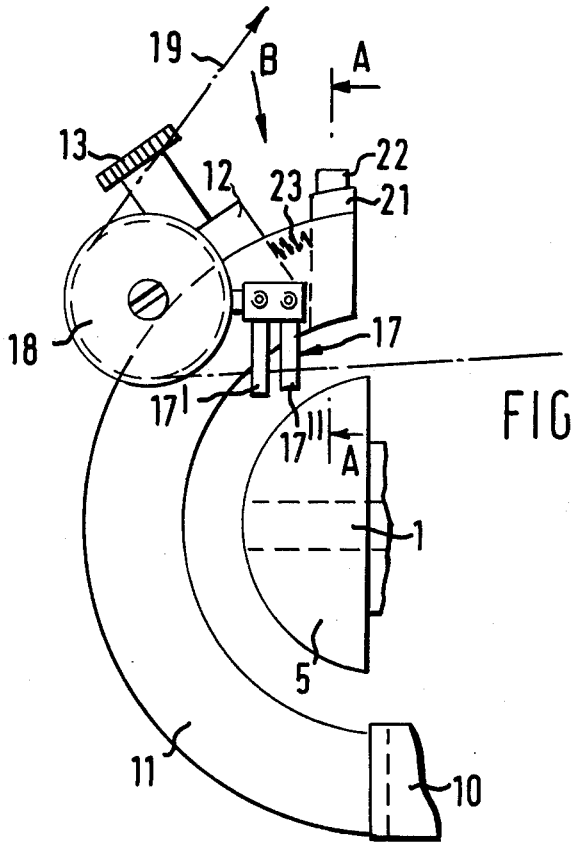
FIG. 3 shows a lateral elevation of a modification of the assembly of FIG. 1.
Figure 4:
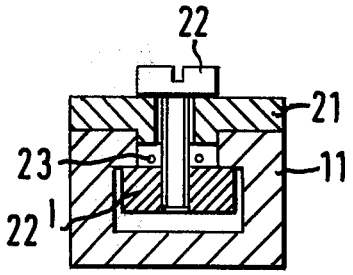
FIG. 4 shows a cross-section on line A—A in FIG. 3 on an enlarged scale.
Figure 5:
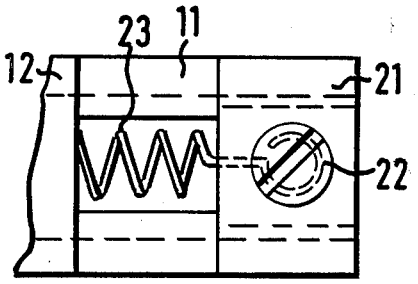
FIG. 5 shows a plan view of a detail of the assembly of FIG. 3 as seen in the direction of arrow B on an enlarged scale.

Referring now to the modification of FIGS. 3 to 5, on the free end of rail 11, there is disposed an abutment 21 fixed by a screw 22 and nut 22'. In the recess of the U-section rail 11, between abutment 21 and sliding element 12, there is arranged a helical spring 23, the last winding of which is bent so as to be fixed to the abutment 21 by embracing the screw 22.

In the starting position, the sliding element 12 is fixed on the arcuate rail 11 in the position shown in FIG. 3 by means of the fixing screws 13, the yarn 19 not being in contact with the spherical segment 5. Now, the fixing screw 13 is released and the yarn applied to the surface of the friction element rotating around the axis of its shaft 1. Thereby, the sliding element 12 is pulled against the abutment 21 by the yarn 19, the cushioning effect of the spring 23 reacting against the pull of the yarn of the sliding element 12. Thereby, the high yarn tension which may appear for a short time when false twising is started is absorbed by the spring 23 and the danger of yarn breakage during the starting phase of the machine is much reduced.

I claim:

1. A friction false-twist device for texturing textile yarns of thermoplastic synthetic material comprising a main friction element mounted to rotate about a first fixed axis and formed with an external surface constituted essentially by a convex surface of revolution about said first axis tapering inwardly towards said first axis from a central location of maximum diameter in each direction to terminal locations, said main friction element being formed with at least one circular groove having its centre on said axis and being substantially displaced from said terminal locations, a secondary friction element mounted to rotate about a second fixed axis parallel to said first fixed axis and comprising as many circular discs as there are grooves in said main friction element, each such disc being centred on the second axis and arranged with a rim portion thereof projecting into an individual one of said grooves, a yarn-guide unit mounted externally of said main friction element, a support for said yarn-guide unit, and means for adjustably positioning said yarn-guide unit on said support, said support and said positioning means constantly locating said yarn-guide unit substantially in a notional plane containing said first axis and arranged for said yarn-guide unit to be fixed in any position about substantially one half of said main friction element at the same distance from said surface of revolution for each such position.

2. A friction false-twist device for texturing textile yarns of thermoplastic synthetic material comprising a main friction element mounted to rotate about a first fixed axis and formed with a spheroidal surface and with a circular groove having its centre on said axis and dividing said surface within a central portion thereof, a secondary friction element mounted to rotate about a second fixed axis parallel to said first fixed axis and comprising a disc arranged with a rim portion thereof projecting into said groove, an arcuate rail extending round substantially half said spheroidal surface at a constant distance therefrom and in a notional plane to which said first fixed axis is parallel, a yarn-guide unit mounted to slide along said rail and means for fixing said unit in any selected position along said rail, the arrangement being such that, when the device is in use, yarn extending partially round said spheroidal surface, while contacting the edge of said rim portion in its passage over said spheroidal surface, passes to said yarn guide unit.

3. A device according to claim 2, in which said yarn-guide unit comprises an open thread guide and a yarn guiding disc serving to deviate the course of the yarn after passing from said main friction element through said open thread guide.

4. A device according to claim 2, in which said yarn-guide unit comprises a sliding element mounted to slide along said rail, yarn guiding elements adjustably mounted on said sliding element for adjustment thereon transversely to said rail, and means for securing said guiding elements in adjusted position on said sliding element.

5. A device according to claim 2, in which said rail has a U-shaped cross-section and said yarn-guide unit is formed so as to engage in the groove constituted by said U-shaped cross-section.

6. A device according to claim 1, in which said means for adjustably positioning said yarn-guide unit comprises a pivotable arm mounted to pivot about said first-mentioned axis and extending transversely with respect to the longitudinal direction of movement of the yarn leaving said main friction element.

7. A device according to claim 2, including an abutment fixed with respect to said rail and a resilient element interposed between said yarn-guide unit and said abutment to serve as a buffer therebetween.

8. A device according to claim 7, in which said resilient element is a spring secured to said abutment.

9. A device according to claim 7, in which said resilient element consists of a mass of resilient material.

10. A device according to claim 7, in which said abutment is adjustably mounted on said rail to be fixed in any selected position therealong.

* * * * *